US005178198A

United States Patent [19]

Fitzgerald

[11] Patent Number: 5,178,198

[45] Date of Patent: Jan. 12, 1993

[54] HANDBAG WITH REPLACEABLE HANDLE

[75] Inventor: Natalie Fitzgerald, Greenwich, Conn.

[73] Assignee: F. A. Sontagg, Ltd., N.Y.

[21] Appl. No.: 647,801

[22] Filed: Jan. 30, 1991

[51] Int. Cl.[5] ..... A45C 1/02; A45C 3/06; A45C 13/22

[52] U.S. Cl. ..... 150/107; 150/104; 150/110; 190/116; 383/13

[58] Field of Search ..... 150/102, 103-106, 150/108, 110, 111, 107; 190/110, 115-118; 383/13

[56] References Cited

U.S. PATENT DOCUMENTS

| | | | |
|---|---|---|---|
| 1,241,890 | 10/1917 | Schrader | 190/116 |
| 1,471,385 | 10/1923 | Critchley | 190/116 X |
| 1,836,970 | 12/1931 | Hiering | 150/110 X |
| 2,537,750 | 1/1951 | Gretschel | 190/116 |
| 2,542,246 | 2/1951 | Grosz | 150/108 |
| 2,720,208 | 10/1955 | Gellman | 150/110 X |
| 2,723,696 | 11/1955 | Kase | 150/104 |
| 2,914,105 | 11/1959 | Kushynski et al. | 150/110 |
| 4,037,633 | 7/1977 | Gordon | 150/110 |
| 4,257,463 | 3/1981 | Monaco | 150/111 |
| 4,424,841 | 1/1984 | Smith | 190/116 X |
| 4,907,633 | 3/1990 | Eckstein | 190/116 X |
| 4,919,240 | 4/1990 | Tobias | 190/116 X |

FOREIGN PATENT DOCUMENTS

| | | | |
|---|---|---|---|
| 373309 | 4/1923 | Fed. Rep. of Germany | 190/116 |
| 2702409 | 3/1978 | Fed. Rep. of Germany | 190/115 |
| 2345101 | 2/1976 | France | 150/110 |
| 491264 | 11/1955 | Italy | 190/116 |
| 19204 | of 1909 | United Kingdom | 150/110 |
| 158423 | 2/1921 | United Kingdom | 190/115 |
| 226678 | 1/1925 | United Kingdom | 150/102 |
| 840343 | 7/1960 | United Kingdom | 190/110 |

*Primary Examiner*—Sue A. Weaver
*Attorney, Agent, or Firm*—Barry G. Magidoff

[57] ABSTRACT

The present invention provides a handbag, for example a lady's handbag, especially a fashionable evening bag, which is equpped with two or more handles. The handles can be in different styles and are removably attachable to the handbag by easily operated, discreet snaps insertable into sockets on the handbag.

6 Claims, 2 Drawing Sheets

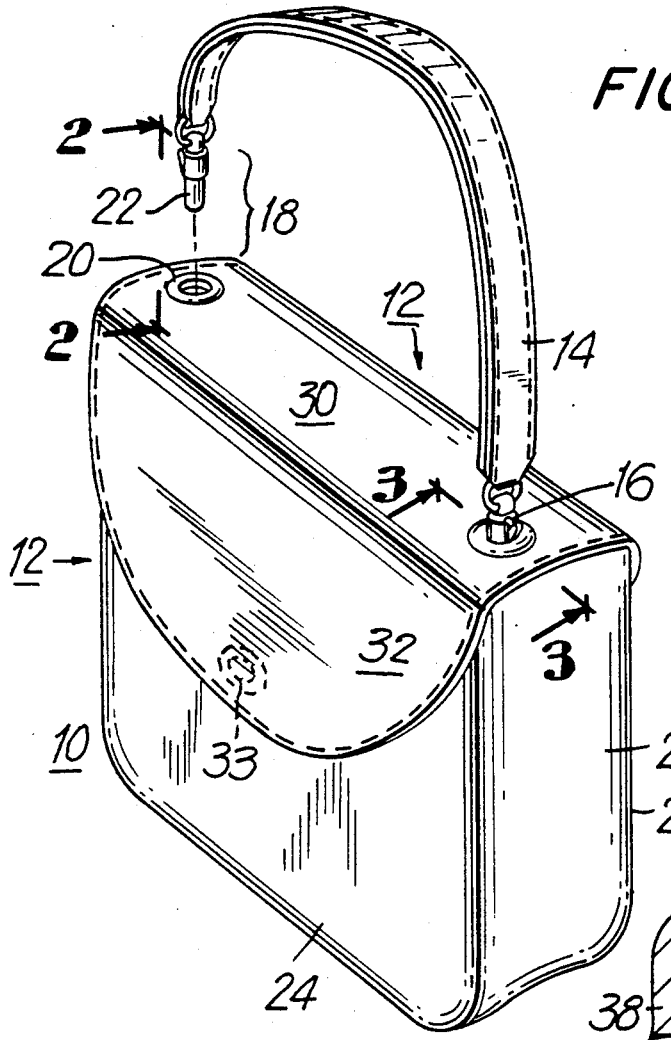
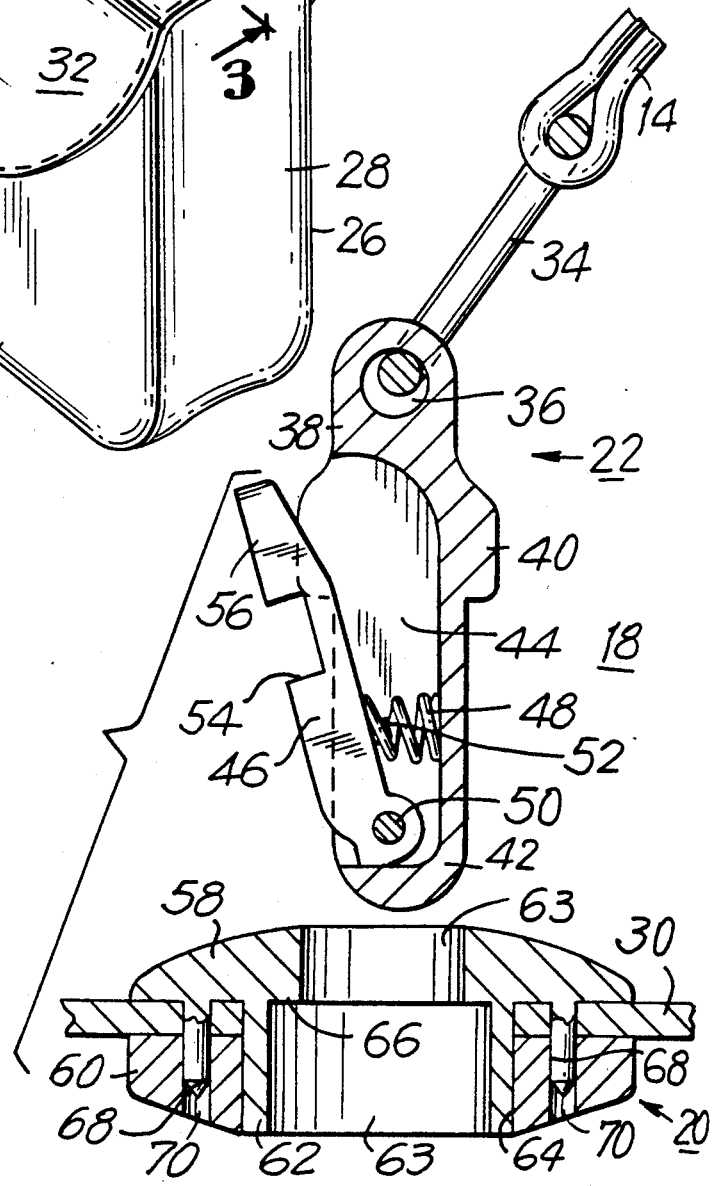
FIG. 2

HANDBAG WITH REPLACEABLE HANDLE

BACKGROUND OF THE INVENTION

1. Field of the Invention

This invention relates to improvements in handbags, especially, but not exclusively, fashion handbags for ladies. (The invention is equally applicable to purses or pocketbooks as well as handbags: The three terms tend to be used interchangeably.)

Such handbags may have a looped handle enabling them to be carried by hand, over the wrist or, with a long enough loop, over the shoulder. As everyone knows, handbags are used to carry all manner of personal effects for example a wallet, makeup, glasses, tissues, lipstick and so on.

2. The Prior Art

Fashion handbags are, of course, a standard personal possession occurring in a multiplicity of styles in many a lady's wardrobe.

The standard parameters of design of a lady's handbag are simple and leave little room for innovation. Typically, a handbag comprises a receptacle with an open top, a flexible loop handle and, optionally, means to close the top which means may comprise a latchable flap.

Handbags, for example totes or briefcases, are known which have a removable handle or strap that is secured to the handbag by spring-loaded latches on the handle that engage with rings on the handbag. These tend to be fussy to unlatch, unattractive and are not sufficiently elegant to be applied to a fashionable evening bag.

Especially upmarket in the fashion industry, mechanical accoutrements of design are not likely to appeal to customers, and indeed are liable to be perceived as gimmicks, deterring potential purchasers.

BRIEF DESCRIPTION OF THE INVENTION

It is an object of this invention to provide a handbag which has improved practicality and lends itself to expression in a range of fashionable designs.

It is a further object of this invention to provide such a handbag which is equipped with a removable handle that is easily manipulated so as to be readily replaceable.

A still further object of the invention lies in providing such a handbag which comprises releasable handle-attachment means capable of having an elegant and fashionable appearance.

Another object of this invention is to provide such a handbag wherein the handle-attachment means is capable of having an appearance not much different from a conventional, permanent handle attachment means.

Accordingly, in one aspect the present invention provides a handbag comprising:

an open-topped receptacle for personal effects;

a removable loop handle equipped with a first attachment structure at each of its ends; and a pair of second attachment structures fastened to the handbag, each said second attachment structure being co-operable with one of said first attachment structures to be capable of releasably attaching said removable handle to the handbag;

wherein said first and second attachment structures comprise a pair of snaps and sockets, which snaps are insertable in said sockets and lockable therein.

In another aspect the invention provides a handbag equipped with a removably attached handle and a detached replacement handle, which handbag comprises:

an open-topped receptacle for personal effects;

first attachment structures, one at each end of both said handles; and a pair of second attachment structures fastened to the handbag each of said second attachment structures being co-operable with one of said first attachment structures to be capable of releasably attaching an end of one of said handles to the handbag;

whereby said attached handle can readily be removed and replaced with said detached handle.

Further objects of the present invention and its features will suggest themselves to those skilled in the art upon a reading of the present specification, together with the drawings annexed hereto wherein, throughout the several views, similar reference characters denote similar elements.

BRIEF DESCRIPTION OF THE DRAWINGS

FIG. 1 of the drawings is a perspective view of a handbag according to this invention which handbag has a receptacle, a cover for the receptacle and a replaceable handle which is removably attachable to the cover at its ends and is shown with one end so attached and the other end detached.

FIG. 2 is an enlarged vertical section on the line 2—2 of FIG. 1 in the vicinity of the detached end of the handle;

DETAILED DESCRIPTION OF THE INVENTION

Figure 3:
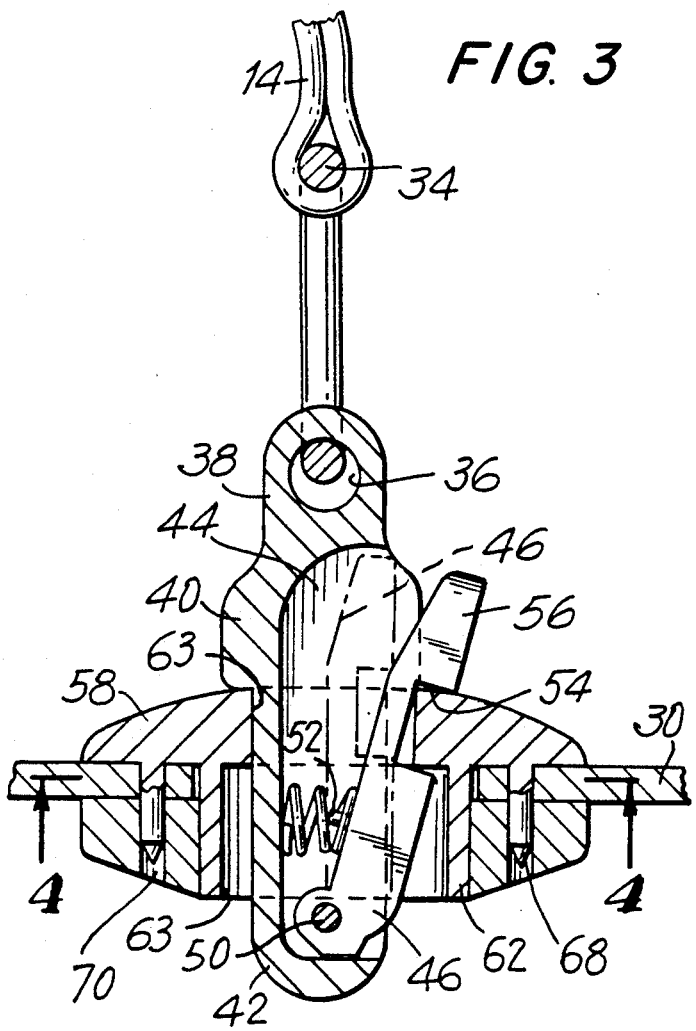
FIG. 3 is an enlarged vertical section on the line 3—3 of FIG. 1 in the vicinity of the attached end of the handle.

Referring now to the drawings, the particular embodiment of handbag, purse or pocketbook shown comprises a rather boxy receptacle 10 for personal effects, to which a foldable flap-like cover 12 is hinged. The replaceable handle, indicated at 14, is strap-like and is secured to the cover 12 at one end by a manually openable attachment means indicated generally at 16. A similar attachment means 18 is provided at the other end of the replaceable handle 14 and the handle 14 extends in a loop between its points of attachment to the handbag.

As may readily be appreciated from FIG. 1, the attachment means 18 is in a detached state and both attachment means 16 and 18 comprise a female attachment structure in the form of a socket 20 mounted on the cover 12 and a male attachment structure in the form of a snap 22 mounted on the replaceable handle 14 and engageable with the socket 20.

The receptacle 10 is of conventional construction with a front wall 24, a rear wall 26, accordion-style side walls 28 (one shown) and a bottom wall (not shown) which can also be of accordion-style construction for front-to-rear expansibility.

Directions used herein, such for example as "left", "right", "front" and "rear", will refer to a head-on disposition of the front wall 24, in a substantially upright position, as shown in FIG. 1.

The receptacle 10 can have a variety of shapes and sizes, but will preferably be somewhat elongated from left to right, as shown, and will commonly have its smallest dimension from front to rear, across the side wall 28. This shape may be generally rectangular, as shown, or generally rectangular with outwardly bowed side walls 28, or substantially square, or generally circular or rounded, or something more ornate. The receptacle 10 is open-topped to allow deposit of personal effects or other articles in its interior and this opening will preferably be elongated from left to right, as shown. Typical personal effects are toilet articles, keys, wallet, cigarettes etc.

The cover 12 closes over the open top of the receptacle 10 and, as shown, is attached to the back wall 26 by glueing, stitching or the like. Alternatively, it may be formed integrally with the rear wall 26 as an upward extension thereof. The cover 12 has a rear panel (not shown), a top panel 30 and a front panel 32 and can be folded, or hinged, about a left-to-right axis so that it may be opened and closed. This foldability can be accomplished by, for example, the whole cover being made of a somewhat flexible material, such as leather, or providing the panels of the cover with some reinforcement, to give them limited rigidity, and allowing the cover to flex between the panels.

The front panel 32 is securable to the front wall 24 of the container 10 by a catch 33. An advantageous catch 33 is a magnetic catch which can be opened or closed with a simple, single action. Such a magnetic catch 33 can comprise a cylindrical, magnetic catch plate and a mating catch having a keeper plate and a locating peg mounted centrally thereof. Properly designed, this catch can be substantially self-locating.

The two sockets 20 of the handle-attachment means 16 and 18 are securely fastened to the top section 30 of the cover 12 in the manner, for example, of rivets; which will be more fully described subsequently.

The receptacle 10 and the cover 12 can be constructed of a variety of materials, for example leather in many of its forms including suede and embossed leather, fabric, plastic and so on. In size, there is no particular limit within the spirit of this invention whose principles may be applied to a wide variety of handbags but, for the particular embodiment of a lady's evening bag, something which can be comfortably held in one hand, for example, but without limitation, six to ten inches wide, is convenient.

The replaceable handle 14 of the embodiment of handbag shown is preferably in the form of a flexible strap or chain, although a rigid handle is possible within the spirit of the present invention. The replaceable handle 14 can be relatively short, as shown, for hand-carrying or maybe longer to serve as a shoulder strap. It may be constructed of a similar material to the handbag itself, or of a contrasting or complementary material according to the desired fashion effect.

Figure 4:
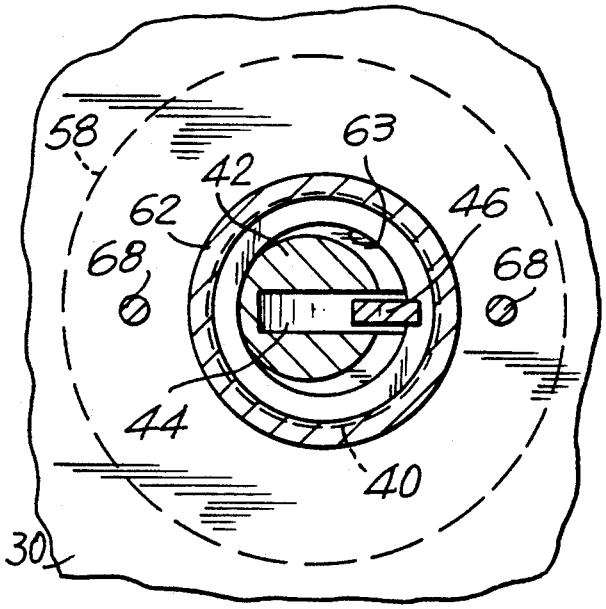
FIG. 4 is a horizontal section on the line 4—4 of FIG. 3.

As is clearly shown in FIGS. 2 to 4, the replaceable handle 14 carries a ring 34 at each end which ring 34 bears a snap 22 and passes through a transverse, front-to-back opening 36 formed in the upper end of each snap 22 for that purpose. This arrangement enables the handle 14 to be swung back and forth about a left-to-right axis across the top of the handbag. The snaps 22 each have the configuration of a small peg which comprises an upper boss 38 in which the opening 36 is formed, a locating shoulder 40 and a downwardly depending body 42 which has a circular section to be rotatable in a socket 20 and is rounded at its lower end for smooth entry into the socket 20.

Mounted in a side cavity 44 of the snap 22 is a manually depressible pivoted locking lever 46 biased outwardly by a compression spring 48. The locking lever 46 is in the form of an elongated finger pivotally mounted in the bottom of the cavity 44 by a pin 50. On an inner face of the locking lever 46 is a small peg 52 to locate the spring 48. Further up on its outer face the locking lever 46 has a cutout 54 serving as a detent to lock the snap 22 in one of the sockets 20. The locking lever 46 terminates at its upper end in a pushbutton 56.

Each of the sockets 20 is formed much like a hollow rivet and comprises an upper, annular button piece 58 on the outer surface of the top cover panel 30 and a lower, annular button piece 60 on the inner or underneath surface of the top panel 30. The upper button piece 58 has a central hollow shank 62 which passes through the top panel 30 to be a close fit in a central opening 64 in the lower button piece 60. The interior 63 of the shank 62 is circular throughout its length so that the snap 22 may rotate or swivel in its socket 20, even while locked therein, and is stepped at 66 to engage the cutout 54 in the pivoted locking lever 46 of the snap 22. In this way, the snap 22 can be held securely in the socket 20 yet still rotate. The upper, narrower portion of the interior 63 is a close fit to the body 42 of the snap 22.

Either side of the shank 62 is a sharp pin 68 each of which passes through the top panel 30 and is a press fit into a corresponding mating opening 70 in the lower button piece 60 so as to clamp the socket 20 securely to the top panel 30 of the cover 14.

The snap 22 can easily be pushed downwardly into the socket 20 and the lower, rounded end of its body 42 guides it smoothly into the interior 63 of the socket 20. The locking lever 46 is pushed back against the spring 48 as the snap 22 progresses into the socket 20 to adopt the retracted position shown in broken lines in FIG. 3 and snaps back outwardly when the cutout 54 engages under the step 66, thus locking the snap 22 securely in the socket 20.

Preferably, the snaps 20 are disposed so that the pushbuttons 56 are conveniently located to be readily felt by a user's finger, for example by facing outwardly towards the side walls 28 of the receptacle 10, or even inwardly, rather than being tucked away and concealed beneath the rings 34.

Also important is that the pushbuttons 56, or other manual actuator, be readily accessible yet be not exposed so that they might catch a garment and be inadvertently opened, possibly causing loss of the handbag and its valuable contents.

Although other materials can be used, the rings 34 and attachment means 16 and 18 are preferably metallic hardware having a high-quality esthetic finish and they may be polished or plated or both. Some examples of suitable materials are brass and brass- or gold-plated alloy.

In use, even the least dextrous or mechanically minded of people can readily find one of the pushbuttons 56 to depress it and release the snap 22 to detach first one and then the other end of the replaceable handle 14 from the handbag. Indeed, with the disposition shown, just placing a finger and thumb on top of the handbag, either side of one of the rings 34, and squeezing gently will usually release the snap 22 and enable that end of the replaceable handle to be detached in one easy movement.

A replacement handle, suitably equipped with similar snaps 22 can readily be fitted by grasping the snap 22 and ring 34 at one end of the replacement handle, which natural grasp will usually depress the locking lever 46 in a single movement, and inserting the snap body 42 into the interior 63 of one of the sockets 20 on the top panel 30 of the cover 14 of the handbag until the locking lever 46 snaps into place. To facilitate this action, it is desirable that the top panel 30 of the handbag's cover 12 not be unduly soft or flexible: thus it can be advantageous to give the panel 30 some rigidity to support the insertion of the snaps 22 into their sockets 20.

It is important to note that because of the unique swivel feature of the attachment means 16 and 18 of this invention, there is no need for a user to fuss with the orientation of the snap 22 in its socket 20: as the second snap 22 at the other end of the replacement handle is brought into position and inserted in the other socket 20, the first snap 22 will automatically swivel to adopt the proper orientation.

Figure 5:
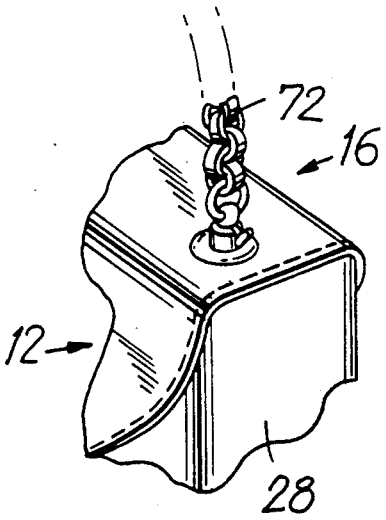
FIG. 5 is a partial perspective view of the handbag of FIG. 1 with a different handle attached.

The replacement handle can be a duplicate of the original, overcoming the problem of excessive wear of the handle 14 detracting from the handbag's appearance. Alternatively, the replacement handle can be a different style to provide fashion variety with economy. FIG. 5 shows a replacement handle 72 which is in the style of a chain, and can, if desired, be long enough to constitute a shoulder strap. Each end of the chain replacement handle 72 is of course equipped with a ring 34 and a snap 22 so that it may easily be attached to the handbag, as described hereinabove. Conveniently, the handbag of this invention is marketed together with one or more replacement handles 72, packed, for example, within the receptacle 10. In one embodiment, such a handbag is supplied with two shorter handles, for hand-carrying, since these are more likely to wear, as well as a longer, shoulder strap or handle, for variety.

The invention thus provides a uniquely useful contribution to the art of fashion accessories enabling an ordinary handbag to be given greater life, increased utility and fashion flexibility, while having an attractive appearance in which its novel mechanical elements are not only most simple to operate, but are barely discernible, even to a critical eye.

An appealing feature of this invention is that the separable attachment means 16 and 18 can be constructed to be nearly identical to the ring-and-post construction which is a common means of attaching a handle to a handbag. The apparent differences therefrom can be restricted to a small opening in the post and a small pushbutton projecting therefrom. The mechanical characteristics of the invention are thus hardly apparent in normal use, presenting themselves only when a handle is replaced.

This feature of the invention is of especial value for higher-priced "designer" or "name-brand" products whose appearance is often well-known and may carry a social cachet which would be destroyed by any significant departure from that appearance.

With minor modification, the socket 20 and snap 22 mounting positions could be reversed, each socket 20 being fastened in a suitable manner to one of the rings 34 on the replaceable handle 14 while each snap 20 is mounted to protrude upwardly from the top panel 30 of the cover 12. Although shown fastened to the cover 30 of the handbag, the attachment means 16 and 18 could, in an alternative embodiment of the invention, be fastened to the receptacle 10, for example at the tops of the side walls 28. Such an embodiment could also be fashioned without a cover.

While described with particular reference to a lady's handbag, as a preferred but non-limiting embodiment, the handbags of this invention can be embodied in many other styles where replaceable handles have utility or fashion appeal. Some examples are a briefcase or garment bag with a stowable shoulder strap and a sports bag or tote with differently colored handles.

The embodiments of the invention disclosed and described in the present specification and drawings and claims are presented merely as examples of the invention. Other embodiments, forms and modifications thereof will suggest themselves from a reading thereof and are contemplated as coming within the scope of the present invention.

What I claim is:

1. A handbag comprising:

an open-topped receptacle for holding personal effects, the receptacle comprising a front wall and a rear wall and side and bottom walls connecting the front and rear walls;

a cover, secured to the rear wall and dimensioned to extend over the open top and at least partially over the front wall, the cover having a top panel and front panel and including means for mutually hingedly connecting together said panels and the rear wall along axes transverse to the side walls;

a two-part latch means, one part secured to each of the front panel and the front wall, respectively;

a pair of attachment sockets fastened to and extending through the top panel;

a removable loop handle having two ends;

two attachment pegs, each one including means for pivotal securement to an end of the loop handle, each peg comprising an elongated body and a biased detent means with means for pivotal connection to each elongated body and biased away from such elongated body, the detent means being constructed and dimensioned to interact with the attachment socket such that each attachment peg is dimensioned to fit removably lockingly within one of the attachment sockets, and thus providing locking means for securing the handle to the handbag.

2. A handbag according to claim 1 wherein each attachment socket comprises a continuous circumferential detent surface, the detent surface facing towards the receptacle, and each detent means comprises a bearing surface which faces generally towards and is in contact with the detent surface, such that the attachment peg is locked into the attachment socket, and that each attachment peg is capable of swivelling in its respective attachment socket when locked in place.

3. A handbag according to claim 2, wherein said pivotal securement means comprises a ring at each end of the loop handle connecting the handle to the attachment pegs, such that said attachment pegs are slidably mounted on the handle and the handle can be swung across the handbag when attached thereto, and wherein each detent means further comprises a finger surface, which is disposed to extend outside the attachment socket and generally towards the loop handle, so as to provide a manually depressible button each said manually depressible button is located alongside one of said rings to be depressed when the ring is gripped to move the bearing surface out of contact with the detent surface, and thus to unlock and permit the removal of the attachment peg from the socket.

4. A handbag according to claim 1, wherein the side and bottom walls are of accordion-style construction.

5. A handbag kit comprising:

an open-topped receptacle for holding personal effects, the receptacle comprising a front wall and a rear wall and side and bottom walls connecting the front and rear walls;

a cover, secured to the rear wall and dimensioned to extend over the open top and at least partially over the front wall, the cover having a top panel and front panel and including means for mutually hingedly connecting together said panels and the rear wall along axes transverse to the side walls;

a two-part latch means, one part secured to each of the front panel and the front wall, respectively;

a pair of attachment sockets fastened to and extending through the top panel;

a first removable loop handle having two ends removably secured to the cover;

a second removable loop handle stored within the receptacle;

four attachment pegs, each one including means for pivotal securement to an end of each loop handle, each peg comprising an elongated body and a biased detent means with means for pivotal connection to each elongated body and biased away from such elongated body, the detent means being constructed and dimensioned to interact with the attachment socket such that each attachment peg is dimensioned to fit removably lockingly within one of the attachment sockets, and thus providing locking means for securing or removing and interchanging the two handles to the handbag.

6. A handbag kit in accordance with claim 5, wherein the first and second removable loop handles are of substantially different lengths.

* * * * *